US010614687B2

(12) United States Patent
Rehfeld et al.

(10) Patent No.: US 10,614,687 B2
(45) **Date of Patent: *Apr. 7, 2020**

(54) ACTIVE INTRUDER MITIGATION SYSTEM AND METHOD

(71) Applicant: Intrusion Technologies, Inc., Matthews, NC (US)

(72) Inventors: Michael Rehfeld, Beverly Hills, FL (US); Stephen Hobbs, Parkton, MD (US); Daniel Mathena, Beverly Hills, FL (US)

(73) Assignee: Intrusion Technologies, LLC, Beverly Hills, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/222,473

(22) Filed: Dec. 17, 2018

(65) Prior Publication Data

US 2019/0139382 A1 May 9, 2019

Related U.S. Application Data

(63) Continuation of application No. 15/683,019, filed on Aug. 22, 2017, now Pat. No. 10,157,525, which is a continuation of application No. 14/755,831, filed on Jun. 30, 2015, now Pat. No. 9,741,221.

(60) Provisional application No. 62/019,026, filed on Jun. 30, 2014.

(51) Int. Cl.

| | |
|---|---|
| ***G08B 13/196*** | (2006.01) |
| ***G08B 29/16*** | (2006.01) |
| ***G08B 15/02*** | (2006.01) |
| ***G08B 7/06*** | (2006.01) |
| ***G08B 13/00*** | (2006.01) |
| ***G08B 15/00*** | (2006.01) |

(52) U.S. Cl.

CPC ..... *G08B 13/19645* (2013.01); *G08B 7/066* (2013.01); *G08B 13/00* (2013.01); *G08B 15/007* (2013.01); *G08B 15/02* (2013.01); *G08B 29/16* (2013.01)

(58) Field of Classification Search

None

See application file for complete search history.

(56) References Cited

U.S. PATENT DOCUMENTS 8,471,676 B1 * 6/2013 Lizaso ..... E05G 5/003 340/5.2

9,741,221 B1 * 8/2017 Rehfeld ..... G08B 13/19645

* cited by examiner

*Primary Examiner* — Sath V Perungavoor

*Assistant Examiner* — Tyler B Edwards

(74) *Attorney, Agent, or Firm* — Caesar Rivise, PC

(57) ABSTRACT

A life safety system for mitigating injuries and fatalities to occupants of a multi-zone structure comprising a plurality of controllers, and coupled to said controller, a plurality of digital imaging devices, a plurality of locking mechanisms, a plurality of dispersion points for the dispersion of at least one dispersible substance, and optionally a plurality of thermostatic members, the foregoing communicatively connected to an intelligent video analysis system. The life safety system further comprises at least one monitoring location physically removed from at least one of said controllers and from at least one of said dispersion points and from at least one of said locking mechanisms and from at least one of said thermostatic members.

17 Claims, 2 Drawing Sheets

ACTIVE INTRUDER MITIGATION SYSTEM AND METHOD

CROSS REFERENCE TO RELATED APPLICATION

This application is a continuation of U.S. application Ser. No. 15/683,019, filed on Aug. 22, 2017, which is in turn a continuation of U.S. application Ser. No. 14/755,831, filed on Jun. 30, 2015, each of which is hereby incorporated by reference in its entirety.

BACKGROUND OF THE INVENTION

The invention described herein relates generally to the field of security systems and more specifically to a system and method for mitigating harm to persons, places or objects in the immediate period following the identification of an active intrusion by a violent attacker.

BACKGROUND

Present systems for observing, deterring and reporting the incidence of an intrusion or violent attack within a facility, such as a school, office building, mall or other location typically comprises passive components such as video cameras, audible alarms and basic communications relays, which alert people in the breached facility to danger and may transmit the fact of the breach event's occurrence to remote locations, such as monitoring stations. The recipient of these alerts and transmissions then places an emergency call to first responders—typically police or firefighters—requesting appropriate assistance. Existing systems may also engage a live feed of data or communications to the remote location, such as a security company monitoring station, or open direct communications with emergency services such as 911.

Further existing solutions to the vulnerability of such locations include armed police presence and building access control mechanisms, which each provides some level of effective protection. However, these solutions cannot provide fully adequate protection due to the passive nature of the access controls and the inability for human safety officers to be present in all areas of the facility, or to be present at all times.

Unfortunate trends in recent history have demonstrated an increase in breaches to multi-zone locations, such as schools, by violent attackers seeking to cause harm to large numbers of people within those locations. Mass shootings and stabbings are examples of these. During the period 1980 through 2012, there were a "total of 137 fatal school shootings that killed 297" people. *Since* 1980, 297 *People Have Been Killed in School Shootings, An interactive chart of every school shooting and its death toll*., Chris Kirk, http://www.slate.com/articles/news_and_politics/map_of_the_weuk/2012/12sandy_hook_a_chart_of_all_196_fatal_school_shootings_since_1980_map.html In contrast, during the period 2007-2011, "U.S. fire departments responded to an estimated average of 5,690 structure fires in educational properties in 2007-2011, annually." *Structure Fires in Educational Properties Fact Sheet*, Richard Campbell, National Fire Protection Association, September 2013. (Available at http://www.nfpa.org/~/media/Files/Research/Fact%20sheet/EducationalFactSheet.pd f) "These fires caused an annual average of one civilian death [and] 85 civilian fire injuries." *Structure Fires in Educational Properties*, Richard Campbell, National Fire Protection Association, September 2013. (Available at http://www.nfpa.org/~/media/Files/Research/NFPA%20reports/Occupanices/oseducat ional.pdf). Despite the vastly larger numbers of fire incidents, the likelihood of injury or loss of life in violent attacks is significantly higher than the risk of death or injury in educational property fires.

The determinative factor in the significantly lowered risk of harm due to fire emergencies versus violent attacks is the ability to mitigate harm in the immediate moments and minutes following identification of the presence of the threat. This results from the preparation and execution of fire safety planning and physical intervention, such as by the use of facility-wide audible and light-emitting alarms, fire suppression systems and the orderly evacuation of occupants from harm's way. This is coupled with training and repeated preparation, such as the fire drills with which most Americans are familiar. These practices carry over to other multi-zone, multi-occupant facilities, such as office buildings and malls.

Since the significant loss of life in the events of Dec. 1, 1958, in a school fire at Our Lady of Angels School in Chicago, Ill., broad changes throughout the nation to fire safety regulations led to the establishment of fire safety procedures and training programs. These procedures aim to remove students, faculty and staff from harm's way as quickly and safely as possible, implementing methods guided by the experience of trained fire safety professionals. These methods have been successful, as evidenced by the nearly complete absence of loss of life in school fires in the last 56 years. In order to achieve the same level of success in improving safety in the active attacker context, it is likewise necessary to alleviate harm immediately upon identification of the active attack situation.

While this is true, "the needs of school security sometimes conflict with the requirements of fire safety. For example, exits may be restricted for security reasons preventing escape should a fire occur. As a result, fire safety experts have increasingly been asked to work in conjunction with security advisors to recommend security procedures that are consistent with the needs of fire safety . . . . School security must not compromise fire safety . . . increased fire safety education, supervision, intervention, and technological innovation." "School Fires", *Topical Fire Research Series*, Vol. 8, Iss. 1, FEMA, August 2007 (https://www.usfa.fema.gov/downloads/pdf/statistics/v8i1.pdf). Thus, the fire safety systems of the prior art are not directly applicable to and have not adequately solved the problem of the mitigation of harm from active intruder situations.

First responders to active attacker situations have demonstrated their ability to arrive upon the scene of such an attack in mere minutes. This is well demonstrated by the events of the Sandy Hook Elementary School shooting, on Dec. 14, 2012, in Newtown, Conn. Following the Sandy Hook shooting, law enforcement conducted a thorough investigation and published a report on the events, including a detailed timeline.

Sandy Hook Response Timeline

Upon the receipt of the first 911 call, law enforcement was immediately dispatched to the school.

It was fewer than four minutes from the time the first 911 call was received until the first police officer arrived at SHES. It was fewer than five minutes from the time the first 911 call was received until the shooter killed himself. It was fewer than six minutes from the time the first police officer arrived on SHES property to the time the first police officer entered the school building.

Below is an abbreviated time line from the first 911 call received to the time the police entered the school building.17

9:35:39—First 911 call to Newtown Police Department is received.

9:36:06—Newtown Police Department dispatcher broadcasts that there is a shooting at Sandy Hook Elementary School.

9:37:38—Connecticut State Police are dispatched to SHES for active shooter.

9:38:50—CSP are informed that SHES is in lockdown.

9:39:00—First Newtown police officer arrives behind SHES on Crestwood Rd.

9:39:13—Two more Newtown officers arrive at SHES and park on the driveway near the ball field. Gunshots are heard in the background.

9:39:34—Newtown officer encounters unknown male running along the east side of SHES with something in his hand.

9:40:03—Last gunshot is heard. This is believed to be the final suicide shot from the shooter in classroom 10.

9:41:07—Information is relayed as to the location of the last known gunshots heard within SHES, the front of the building.

9:41:24—Newtown officer has unknown male prone on ground, starting information relay regarding possibly more than one shooter.

9:42:39—Newtown officer calls out the license plate of the shooter's car.

9:44:47—Newtown officers enter SHES.

9:46:23—CSP arrive at SHES.

9:46:48—CSP enter SHES.

As the gravity of the situation became known, local, state and federal agencies responded to the scene to assist . . . .

Stopping the active shooter was the first priority.

"*Report of the State's Attorney for the Judicial District of Danbury on the Shootings at Sandy Hook Elementary School and* 36 *Yogananda Street, Newtown, Conn. on Dec.* 14, 2012", Stephen J. Sedensky III, Office of the State's Attorney, Nov. 25, 2013. (Available at http://www.ct.gov/csao/lib/csao/Sandy_Hook_Final_Report.pdf)

The first responding police officer to the Sandy Hook scene arrived less than four minutes after the first 911 call reporting the incident and the last gunshot was heard a mere one minute after that. Despite this remarkable response time, as a result of a violent attacker event lasting less than five minutes, "eighteen children and six adult school staff members were found deceased within the school. Two more children were pronounced dead at Danbury Hospital. Two other adult school staff members were injured and were treated at nearby hospitals and survived." *Ibid*. These events therefore show that, despite the ability to place law enforcement on the scene within minutes, immediate physical and methodical intervention remains necessary in order to reduce loss of life and injury.

Similar well-documented events have occurred at numerous locations, including the Columbine High School shootings in 1999, the 2007 mass shooting at Virginia Tech and the Columbia (Md.) Mall shootings of 2014.

It has also been shown, that armed response to an active violent attack is not consistent and that, as expected, increased response time results in increased injury and loss of life. On Sep. 16, 2013, a gunman at the Washington, D.C. Navy Yard killed 12 victims and injured 8 others before law enforcement was able to stop the active shooter. According to reports of the incident, 'the first call for help came at 8:21 a.m. that morning, and it took officers another 30 minutes to find [the shooter] . . . . The shooting continued for 30 minutes before police and other first responders encountered [the shooter], hidden in a maze of cubicles." *FBI: Took* 30 *Minutes to Find Navy Yard Gunman,* 4 NBC Washington, Sep. 19, 2013 (Available at http://www.nbcwashington.com/news/local/New-Timeline-Emerges-of-Navy-Yard-Shooting-224442141.html)

A clear need therefore remains for a system and method to mitigate harm to persons and damage to property immediately following identification of an active intruder situation, in the time before first responders are able to arrive.

Existing Technologies and Methodologies

It is known in the art, as shown for instance in U.S. Pat. No. 6,204,760 issued to Brunius, to identify multiple zones within a facility, each zone to be considered an individual segment of the entire facility and to place within each zone unit controllers, communicatively coupled to a main, remotely located controller. In such systems, the unit controller identifies the existence of an alarm condition and, unless the unit controller receives appropriate input from a user, invalidating such alarm condition, communicates the alarm condition to the remote, main controller.

It is further known in the art to collect video or sequential photographic images of a monitored security zone within a multi-zone security site, either continuously or at specified intervals, and to transmit these images to a system or human operator located remotely from the security site. U.S. Pat. No. 7,468,663, for example, granted to Rufolo, provides for the transmission of such captured video to police or other authorized external personnel. By way of further example, International Patent Application WO97/41692, by inventors Hackett et al., provide for the transmission of images "to a monitoring station for display to a human operator for analysis." The collection and transmission of these images may, in existing systems, be initiated in response to a triggering event; for instance, detection by a sensor of movement, sound, temperature change or other environmental events or factors, or in response to a manual triggering request from an operator of the system. The ADT Pulse® video surveillance system (http://www.adt.com/video-surveillance), for instance, triggers video capability in response to detected motion.

Further existing technologies permit the control, from remote locations, of automated security door locking mechanisms, such as shown in U.S. Pat. No. 8,471,676, by Lizaso. Lizaso teaches the use of programmable logic controllers (PLC's) for the implementation of such control.

Various other features of such systems or stand-alone devices and methods have been taught. For example, European Patent Application No. EP2 595 125. By Vandoninck, contemplates a Self-Defense System Comprising a Fog Generator for generating fog inside an area in response to operation of an activation switch.

Despite the existence of such technologies, present systems do not provide for full integration of these existing technologies, coupled with a system and method for activating and operating them, including automated sequential actions based on knowledge and strategic planning, aimed to control the active intruder himself. In essence, current systems have achieved little more than placing each of these systems in a facility to operate as they would individually. This is demonstrated by the recent installation of a multi-component system in a Las Cruces, N. Mex. school. See *Public-school system automates lockdown process with integrated solution*, Urgent Communications, May 23, 2014 (available at http://urgentcomm.com/campus/public-school-system-automates-lockdown-process-integrated-solution?NL=UC-03&Issue=UC-03_20140529_UC-03_293).

The need therefore remains for a system and method that provides more than the simple combination of existing components.

A clear need therefore remains for an active intruder mitigation system and method to mitigate harm to persons and damage to property immediately following identification of an active intruder situation, in the time before first responders are able to arrive and to programmatically initiate, select and control the execution of appropriate steps leading to safer outcomes.

All references cited herein are incorporated herein by reference in their entireties.

BRIEF SUMMARY OF THE INVENTION

It is broadly desirable to provide an active intruder mitigation system—a specialized form of life safety system—and method for mitigating harm that may occur to persons or property in the critical time immediately following the first identification of an intrusion and active or imminent violent attack. This time, before which law enforcement and other first responders are able to arrive upon the scene of the intrusion and/or attack, is critical to facilitating safe outcomes for threatened persons at the scene of such intrusion.

Specifically, it is contemplated by the present invention to provide an integrated building security system that will: facilitate automated detection of an active violent or threatening intrusion, or be manually activated by a person in response to learning of an active violent or threatening intrusion; means for providing notification to potential targets of an attack by the intruder; and notice to administrative personnel of the breached location; communication to remote parties, such as law enforcement; video or sequential image surveillance and communication of captured video or images; entry and exit locking systems and mechanisms both between zones of the secured structure and between the interior of the structure and the exterior; systems for dispersion of an airborne, visibility obfuscating material; and associated means of control of each of these components. These components may also include temperature-sensitivity of the airborne, visibility obfuscating material and control of the ambient temperature and other climate parameters of the secured location.

The components of the system are operated in accordance with the disclosed method in order to contain the attacker or lead the attacker toward containment or forced exit from the structure, as determined by the system and operators thereof, and to expeditiously remove occupants of the facility from areas of threat to pre-determined or dynamically determined areas of safety, interior or exterior to the location, removed from the threat of the attacking intruder.

The invention provides a unique coordination of wired and wireless components to ensure a facility-wide protective system for occupants of structures targeted by violent acts. This series of components has been designed to ensure failsafe control of the inventive system's communication backbone and other components so the active intruder mitigation system is functional at all times. The system provides redundancy and back-up components that maintain operability of the communication network between system components, the people, structures and assets being protected, local or remote administrators of such locations, and external parties—including law enforcement, security personnel and the like—or systems receiving system communications or transmitting information, control or communications to the system.

Configuration and unique programming of the communication network of the system and its various components allows for transmission of event information from zonal components to a zonal module and/or a central programmable logic controller (PLC) or processor (collectively referred to herein as a "controllers" or "modules" unless otherwise indicated) either directly or through the zonal module. Communications processed through the zonal controller are relayed via wireless and/or wired transmission components to the main controller, providing system awareness of the occurrence of an event and the type of event occurring and permitting the initiation of protective steps, including system and human confirmation of the event and subsequent actions for the achievement of safe outcomes.

Once the signal or signals have been received at the zonal controller, system instructions and communications are fed to components of that zone—such as locking mechanisms for entry and exit paths—immediately engaging protective measures and communicating information or instruction. The signal is simultaneously sent to the central PLC/processor for the initiation of centralized, specified zonal, or remote actions. Action signals and information are transmitted via wireless and wired means to the other zonal modules to engage all protective measures consistent with the identified threat and system programming.

Programming or circuitry of the main PLC/processor transmits a signal and/or information to the local emergency responder's network, communicating information of the attack. The main PLC/processor also initiates transmission of a digital video or sequential image feed from some or all zonal cameras to the local emergency responders. System instructions at the main PLC/processor, upon receipt of information signaling detection of appropriate circumstances, engage a disorienting "fog" for visually obfuscating selected zones or portions of zones within the structure. Once communication from the main PLC/processor is received the fog is activated as directed at the zonal fog component. Building climate control systems may be operated in conjunction with the zonal fog components, as described further herein, to further control the behavior of visibility obfuscating media, such as the emitted fog.

This multi-disciplinary system, including video, audible and visual notification, temperature control, safe room provisioning and protective measures, and visual impairment, tied in a unique communication method for logical activation provides unique maximization of the protection of lives within the protected facility.

Although certain of these component capabilities exist in prior art singularly, the holistic, and simultaneous aspects of the system media, components and logic are unique to the invention and extend beyond the mere combination of those components. Utilizing unique programming of the PLC/processors as well as the wireless and wired communication device(s) the invention, in concert, provide the lifesaving, novel benefits of the disclosed invention.

DETAILED DESCRIPTION OF THE INVENTION

Figure 1:
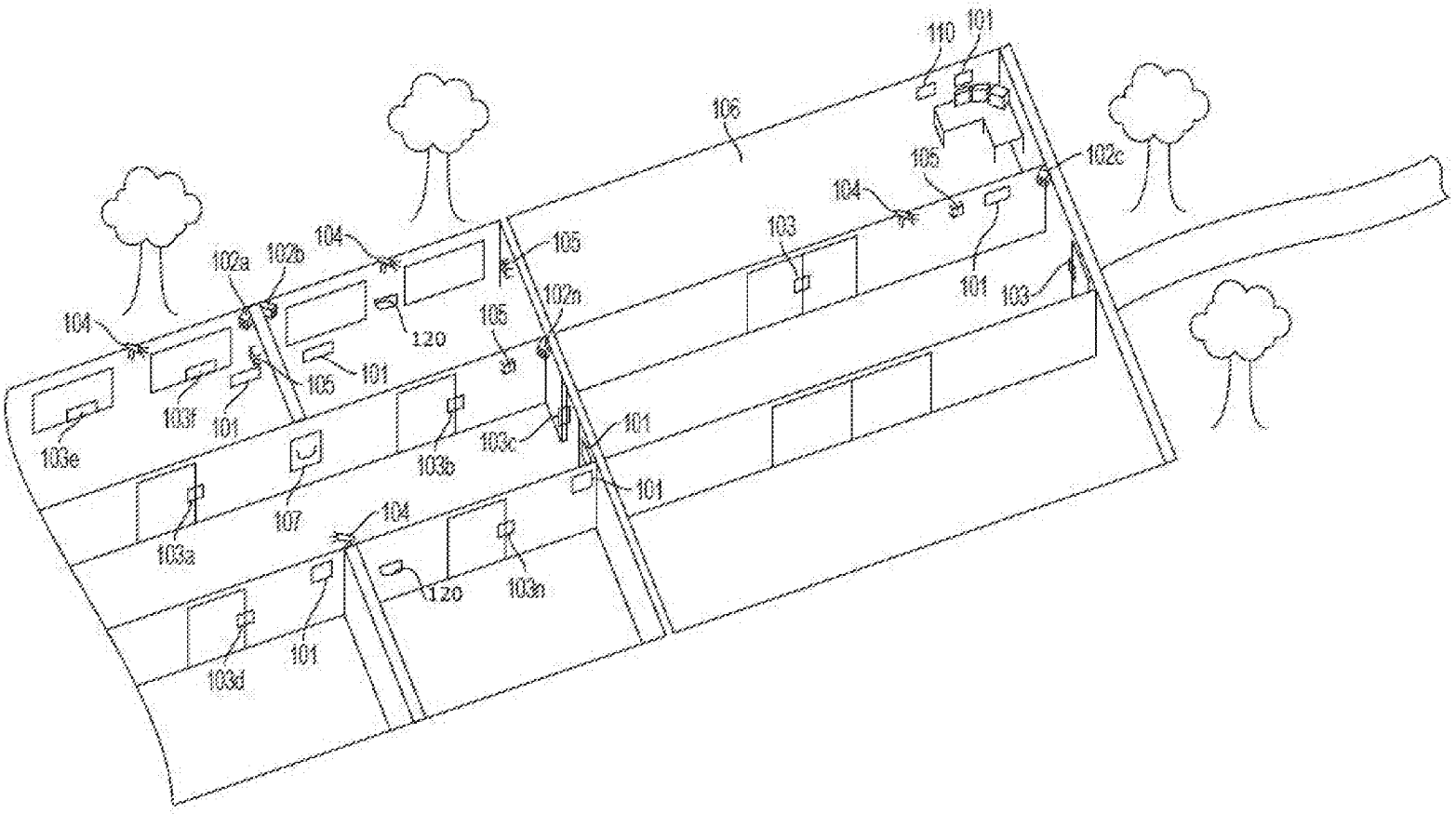
FIG. 1 is a perspective view of an exemplary multi-zone structure with the present active intruder mitigation system installed.

The invention of the present disclosure is described below with reference to certain embodiments. While these embodiments are set forth in order to provide a thorough and enabling description of the invention, these embodiments are not set forth with the intent to limit the scope of the disclosure. A person of skill in the art will understand that the invention may be practiced in numerous embodiments, of which those detailed here are merely examples. In order to allow for clarity of the disclosure of the claimed invention, structures and functions well known to those skilled in the art are not here disclosed. Those skilled in the art should also realize that equivalent Active Intruder Mitigation Systems do not depart from the spirit and scope of the invention in its broadest form.

Specifically, it is contemplated by the present invention to provide an integrated building security system that will: facilitate automated detection of an active violent or threatening intrusion, or be manually activated by a person in response to learning of an active violent or threatening intrusion; comprise means for providing notification to potential targets of an attack by the intruder and notice to administrative personnel of the breached location; permit communication to remote parties, such as law enforcement; effect video or sequential image surveillance and communication of captured video or images; further comprise entry and exit locking systems and mechanisms both between zones of the secured structure and between the interior of the structure and the exterior; further comprise systems for dispersion of an airborne, visibility obfuscating material; and further comprise associated means of control of each of these components. These components may also include temperature-sensitivity of the airborne, visibility obfuscating material and control of the ambient temperature and other climate parameters of the secured location.

The components of the system are operated in accordance with the disclosed method in order to contain the attacker or lead the attacker toward containment or forced exit from the structure, as determined by the system and operators thereof, and to expeditiously remove occupants of the facility from areas of threat to pre-determined or dynamically determined areas of safety, interior or exterior to the location, removed from the threat of the attacking intruder.

In an exemplary embodiment of the present invention, controllers, which consist of programmable logic controllers (PLC's) or microprocessors (collectively referred to herein as a "controllers" or "modules" unless otherwise indicated), are installed in multiple zones of a building. These controllers may include stand-alone operation by virtue of their programming, may be communicatively connected to control mechanisms such as computer systems or manual activation systems, for example, switches, buttons or interactive keypads or interfaces, by remote activation or control, or they may operate in one or more of the foregoing manners. The controller of each zone is programmed to control locking mechanisms of doors and windows, which comprise points of entry to and egress from the zone. The controller is further programmed to activate and provide automated, or local manual, or remote control of video or photographic equipment within the zone. In this context, local refers to persons or mechanisms located within the protected structure, whereas remote refers to persons or systems outside the structure which may, in certain cases, be permitted control of or communication with the active intruder mitigation system.

The controller is further still programmed to control dispersion mechanisms for the emission of airborne material, such as fog, which may be used to obscure visibility within the zone. One or more of the controllers of the exemplary embodiment is further still programmed to control or provide control of thermostatic mechanisms for controlling the ambient temperature within one or more specified zones.

An exemplary embodiment further includes communication means, such as wired connections or wireless communications, permitting the controller or controllers to communicate with remote locations and systems. Remote communication targets include external administrative locations of the facility, such that an authorized member of the facility staff, with properly authenticated access may initiate or receive communication from the controller to a remote device located in the administrative location. For example, a PLC or processor of one or more zones may transmit to a computer within the administrative location the state of one or more of the components of the system connected to that PLC or processor. Another remote communication target includes a security monitoring station located outside of the secured location. By the activation of video relay to these remote communication targets, the system provides methods for human visual verification of reported states. This permits the authorized user of the system to activate/trigger or override certain system operations, such as the dispersion of vision-obscuring media or the operation of locking components, as described herein.

A further remote communication target includes an emergency dispatch center, such as a local police department or 911 system.

Referring now to FIG. 1, an exemplary multi-zone structure is illustrated with an installed active intrusion mitigation system in accordance with the present disclosure. The multi-zone structure shows installed zonal controllers 101*a-n* in each zone of the structure. In the illustrated case of FIG. 1, each room is defined as a zone and therefore has a zonal controller 101. Each zone of the multi-zone structure is equipped with a camera 102 for observation of the zone. The camera of each zone is in communication with the zonal controller 101 of its zone and may also be in communication with a main controller 110 for the transmission of captured images, which may be still or video images, to the controllers 101, 110. The points of entry and exit in each zone, including in this case doors and windows, are equipped with locking mechanisms 103 also in communication with the zonal controller 101 and potentially the main controller 110. Within at least a subset of the zones is installed a plurality of dispersion points 104 for emitting a substance that will produce fog or other medium to obscure the vision of a person in that zone. Also shown are thermostats 105 for observation of the ambient temperature in the zone, communicatively connected again to the zone and/or main controllers 101, 110. The thermostat 105 of any zone may also be selected to have capabilities of measuring other environmental factors, such as humidity. FIG. 1 additionally depicts within one zone of the multi-zone structure a monitoring location 106, which is removed from the other zones, but is capable, via communication between the components of the system, of receiving data from at least the zonal controllers 101 regarding the other system components within the zone of the communicating zonal controller. The monitoring location may also be capable of receiving data directly from a non-controller system component if it is directly communicatively connected to the main controller 110. Within the hallway area shown in FIG. 1 is an active intruder signaling station 107, which is manually operated by a structure occupant upon the discovery of an active threat for initiation of system activity and transmission of alerts to at least the main controller 110.

Active Intrusion Detection

As just stated, intrusion may be detected by an occupant of the protected structure who will then operate the active intruder signaling station 107. In alternate embodiments, one or more zones of the multi-zone structure may be equipped with sensors for automatic detection of intrusion or a likelihood of intrusion. Such sensors may include shock sensors placed upon windows to detect breakage, sensors placed upon doors or door locking mechanisms to detect forced entry and other such known sensors. Some embodiments may further include audio sensors 120 capable of automated recognition of the distinctive sound of gunshots or other life threatening occurrences consistent with the existence of a violent intrusion and threat to occupants of the protected structure.

System Component Activation

Activation of the active intruder mitigation system may be triggered in response to automated detection of such intrusion by the system or activation may be triggered by manual operation of a system trigger station 107, similar to fire alarm pull stations, security panic buttons and the like. Upon activation of the active intruder mitigation system, communication from at least the zonal components of the detection is established to the main controller 110. System parameters may require human verification of the active intrusion or may trigger further action immediately.

Such further action in the preferred embodiment includes activation of all visual monitoring mechanisms 102*a-n* throughout the multi-zone structure. In some embodiments, initial activation will also include initiation of communication from the main controller 110 to a remote monitoring location, either directly connected to law enforcement and/or a 911 system, or connected to a remote, third-party security monitoring location. This communication will include at least two-way audio communication between the local monitoring location 106 and the remote monitoring location and may also include initiation of a video feed from the main controller 110 and, in some embodiments, full control by personnel of the remote monitoring location of the main controller 110 and thereby the rest of the active intruder mitigation system components.

Notification of Potential Targets and Administrative Personnel

An exemplary embodiment of the present system includes means for communicating to occupants of the installation location either visually, audibly or both, information regarding the circumstances of an intrusion and/or attack and instructions for securing themselves in a particular location, relocating to another location or point of egress, or other behavior that will increase the likelihood of positive outcomes and reduction of harm to those persons. These means for communicating with the occupants may include lighting signals, such as strobes, alert sounds such as sirens or more sophisticated mechanisms such as electronic signage permitting the display of specific words or images.

In the use of such communication means, the system in some embodiments may employ different colored light signals, for which occupants of the structure will have been trained regarding their meaning. For instance, but not limitation, a red light may signal the identification of a violent intrusion, whereas the illumination or strobe of a yellow light may indicate that occupants should move toward such light.

The notification means in some embodiments will include speakers, such as in public address systems and some security or fire alarm systems, permitting the announcement into one or more zones of instructions or information, either by an operator of the system, member of law enforcement with access to the system or by pre-recorded message.

Communication to Remote Parties

Communication to remote parties in an exemplary embodiment includes indication of the occurrence of an event. It is then necessary to determine the type of event that is the cause of the initiation of the system and to confirm that such event is occurring.

Type of Event

Determination of the type of event occurring may be made by visual observation of the transmitted video or images from the camera components 102 via the controllers. In certain embodiments it is possible for the system to automatically determine an event type and indicate such by its data transmission. For example, as discussed above, audio recognition may be employed to recognize and signal the occasion of gunshots by operation of the system's audio sensors 120 in communication with one or more zonal controllers 101 or the main controller 110. Sensors may also be employed to determine forced entry. In alternate embodiments, persistent visual monitoring coupled with image recognition may trigger an alert based upon the system's recognition of visual evidence of a threat, such as a gun, knife or other weapon on the premises of the protected structure, without the requirement for occupant triggering of the system or the occurrence of an acoustically discernable event.

Confirmation of Event

Regardless of the method of activation of the system, confirmation must be made of the occurrence of an event and the type of threat present. This confirmation is facilitated by the communication of visual images from each zone, captured by the zonal cameras 102 and transmitted via the zonal controllers 101 to the main controller 110 and thereby the local monitoring location 106 and any connected remote monitoring parties.

Visual Surveillance and Communication Thereof

The camera components 102 of the system are equipped to collect and transmit video or sequential still images from the camera's zone to the local monitoring location 106 and/or to external monitoring locations to facilitate confirmation of the reported event, observation of the subsequent events and supervision of tactical decisions for the achievement of intruder capture and safe outcomes for the threatened occupants. One of skill in the art will understand that various visual surveillance means may be used, including but not limited to standard closed circuit television cameras, digital video cameras or digital still cameras. Such cameras will be communicatively connected to the system. In the preferred embodiment, such connectivity is made first through the zonal controller 101 and thereby to the main controller 110 and local monitoring location 106. Camera communication with the controllers may be through wired or wireless means.

Entry and Exit Locking

Critical to the operation of the system is the placement of electronically operable locking mechanisms 103 on doors of zones that may require securing and the structure's exterior doors. As described in further detail herein, the operation of such locking mechanisms, controlled by the zone controller 101 and alternatively by the main controller 110 provide the ability to provision safe rooms where threatened occupants can gather and be secured from the active intruder. Locking mechanisms 103 may also be used to force the intruder to travel paths within the structure, determined by the system programmatically or by a system operator, most likely to lead the intruder away from threatened occupants and toward capture. One of skill in the art will recognize that this may include operation of locking mechanisms 103 so as to encourage the travel path of the intruder to the exterior of the building.

In the just described way, the locking mechanisms 103 may also be operated—alone or in conjunction with the visibility obfuscating material described below—to effectively create mantraps within the protected structure to which the intruder may be led.

It will be understood that locking mechanisms 103 in the disclosed system may be of various types. Examples may include physical locking mechanisms, such as deadbolts, or other known lock types, whether mechanical, electrical, magnetic or otherwise. Such locks may be mechanically or otherwise operated, for example, by the presentation of a magnetic or RFID access card to a card interrogator coupled to a building access authorization system. In the case of some violent events, the perpetrator may have gained access to areas by authorized operation of such locking mechanisms. It is contemplated by the present disclosure that identification of such authorized entrant as a threat actor will result in the revocation of such authorization and the system's operation of the locking mechanisms 103 may then, accordingly, be made inoperable to the formerly authorized, now-threatening actor.

In a preferred embodiment of the present invention such recognition of the formerly authorized entrant as a threat may be entered into the system by an operator at either the local monitoring location 106 or by an operator—for example, an administrator of the building or law enforcement—from a remote monitoring location or control location.

In an alternate embodiment of the invention, recognition of a formerly authorized entrant as a threat may be determined by facial recognition software within the system coupled with other system collected data or other data entered by an operator.

In both such embodiments, and in other variations, the revocation of a formerly authorized entrants building access control rights may be complete or partial. That is, operation of certain doors, windows or other access controls (including, for example, elevators) may be restricted, while others remain available to the violent actor. This selective provisioning of access rights may be coupled with the path determination logic of the system in order to achieve the routing functions discussed herein, with respect to the violent actor. This selective provisioning may be dynamic so that the controlled path of travel of the actor may be influenced at any time depending upon the available situational information. As such, the pathways available to the actor may change at any time until his capture.

In some embodiments, where selective locking mechanism access control is provided, the system's determination that access should be granted may be made not solely as a function of physical routing, but also as a function of time. In such instances, locking mechanism-controlled steps of the routing functionality may computationally include time-series or time-expanded calculations, such that determined paths for the actor and for those being evacuated may be coordinated to permit the use of common travel paths for both, while avoiding their simultaneous presence in or on those same paths or portions of the paths.

Dispersion of Visibility Obfuscating Material

Another aspect of the exemplary embodiment is the use of dispersion mechanism, controlled by the PLC or processor, to disperse a vision-obscuring medium into the air of a zone. The dispersion of this material, for example, fog, temporarily inhibits the vision of the violent attacker, thereby preventing him from sighting and targeting potential victims within the zone. The dispersed material is comprised of a temperature sensitive chemical or combination of chemicals such that the material will remain airborne and dispersed as long as the ambient temperature of the zone remains within a specified range (specific to the chosen material). Because the dispersed vision-obscuring medium of the exemplary embodiment is temperature sensitive, the PLC or processor may programmatically or through manual direction activate the thermostatic component of the system, in turn activating localized zone temperature control that will cause the ambient temperature to deviate from the specified range and cause the dispersed vision impairment material to settle toward ground level. In this way, the use of the dispersed vision-obscuring medium does not hinder police or firefighter activity upon their arrival into the visually impaired zone. Upon such arrival, the activation of the thermostatic mechanism and change in ambient temperature will permit the fire or police personnel, directly or via remote intervention, to cause visibility to quickly return to the zone, permitting capture of the attacker, attending to injured or secreted victims or human targets or extinguishing of fires within the zone.

In a preferred embodiment of a system according to the present disclosure, the vision-obscuring medium is an atomized glycol fog comprising distilled water and one of glycerin, propylene glycol or another glycol, variants of which, such as propylene glycol, will be known to one of skill in the art. One of skill in the art will understand that concentrations of approximately 15% or less of glycol will result in a thin, haze-like dispersion, whereas greater concentrations will result in thicker, denser fog. Such variations in concentration will also result in changes, in direct relation, in the rate of dissipation of the dispersed fog. A glycol fog will also exhibit the temperature sensitive properties of the present disclosure where increases in ambient temperature will reduce the effective density of the produced fog and decreases in temperature will result in increased density. Therefore, as described above, the glycol fog may be quickly dissipated by increasing the ambient temperature to the appropriate level based upon the glycol concentration of the vision-obscuring medium mixture in the particular embodiment of the system and known properties of relation of such concentrations to temperature change. In keeping with the teaching herein, the ambient temperature may rather be cooled, causing the described increase in the density of the vision-obscuring medium, resulting in the fog settling toward the floor. Either of these methods will thereby restore visibility to the temperature-controlled zone.

In an alternate embodiment, the dispersion mechanism may be arranged to permit the dispersion of two chemicals or chemical compounds, whereby the first dispersed material remains airborne as previously described and for the purposes previously described. The second dispersed material is chosen such that its dispersion will cause a chemical reaction with the first dispersed material, resulting in combination of the first and second dispersed materials and causing the resultant to sink toward ground level, thereby returning visibility to the zone without the need for control of the ambient temperature. This alternate method of dissipating the vision impairment material and restoring visibility to the zone may be particularly useful when fire within the zone prevents accurate control of the ambient temperature, when the thermostatic mechanism has been damaged or destroyed, when no thermostatic mechanism is present in the zone or when ambient air temperature control cannot be accurately restricted to a single zone and multiple zone temperature changes are not desirable. Examples of possible secondary compounds may include water vapor, additional glycols and other materials that would be known to one of skill in the art, that will result in a chemical combination having greater specific gravity than the initial vision-obscuring medium alone when settling is desired or lower specific gravity if appropriate in the embodiment of the system.

Other embodiments may employ other known means of generating the vision-obscuring medium, such as dry ice, water vapor or any chemical, compound or element known to produce such output under proper conditions.

Occupant and Intruder Travel Path Determination

In one exemplary embodiment of the claimed invention, a main controller of the system may calculate a preferred path of travel for one or more intruder or for threatened occupants of the multi-zone structure and encourage the intruder or occupants to travel such path by use of the dispersion mechanisms and temperature sensitive/chemically reactive properties of the fog-generating substance, or such other components of the system as may be appropriate, such as audio communication or visual signaling mechanisms. In such embodiment, the system identifies, either through image or video recognition methods or by manual input, the location of non-attacker structure occupants and the location of the attacker. The system identifies, through one of the same methods, at least an estimate of the number of such occupants or attackers in each identified area. The system further identifies saferooms within the structure and egress points to the structure's exterior. The system receives verification of the desirability of routing the occupants to such locations for secreting or egress, for example, by programmatically determining the absence of an attacker in such areas through image or video recognition, or by presentation of such potential destinations to an administrative or law enforcement user for acceptance. Similarly, the system determines the desirability of routing an attacker to each such location for containment, egress or capture. The system then calculates, typically through known pathfinding algorithms such as Dijkstra's algorithm, or variations thereof, such as multiple source shortest path computation, the possible paths for the identified person or persons to travel to the selected destination areas. The system then selects the shortest path of travel for one or more of the identified groups—attacker or threatened occupant—where the selected path of occupant travel will not cross the selected path of attacker travel. The system may be configured or receive input to also select such paths in order to maximize the separation of the paths of travel of the threatened occupants and the attacker or attackers. Further still, the paths may be selected by weighting the paths based upon estimated travel time along each path given the distance, number of persons who must travel the path and the ability to operate other components of the system to control the total travel time.

Further expanding upon the path routing capabilities of the system, one preferred embodiment will maintain data representing each known, usable egress point, such as doors and windows, and all points having locking mechanisms that are components of the system. The system will further maintain digital data representing the paths between each of these points, including at least the length of those paths. These data may be used to construct a graph data structure, wherein egress and locking mechanism points represent nodes and paths between them represent edges with weights equal to the path lengths or an otherwise entered weight. In such an embodiment a shortest path may be calculated to route a person through the methods described herein, such as Dijkstra's algorithm, from any point to another. In some embodiments, the shortest path calculation may be computationally cross-checked or manually overridden, causing the system to recalculate a shortest safest path, which may or may not be as short as the originally computed, objectively shortest path, in absolute distance terms. By the inclusion of this functionality, the route provided to the attacker or a threatened occupant may be determined with consideration for the presence or proximity of the attacker to the paths comprising the route of non-attacker occupants and vice versa, the existence of identified hazards, the capacity of the path in view of the number of occupants to be routed and the time necessary for traversing such path. As described above, such computation may work in concert with the locking mechanisms of the system. In some such embodiments, the data stored by the system may include or be dynamically supplemented by time-series or time-expanded data to influence the operation of the system and its communication or generation of passable safest routes.

Having selected such paths, the system initiates dispersion of the vision obfuscating substance and engagement of locking mechanisms in a coordinated manner to encourage the travel of each of these groups along the identified travel path. The system disperses fog from the dispersion mechanisms in greater opacity in the areas from which the subject should be directed away and in lower opacity (or not at all) in the areas and directions toward which the subject should travel. In such manner, the subject is guided along the selected path. This selective fog density may be accomplished or facilitated through any of the various methods discussed in the present disclosure, including but not limited to the engagement of HVAC systems within specified zones to cool the medium, causing it to settle in the cooled zones or through the dispersion in selected zones of a second medium that will chemically react with the first medium, causing it to settle to the floor in the selected area, thereby improving visibility and guiding the path of travel.

The system also operates locking mechanisms of doors or windows to permit or restrict path travel. In areas occupied by threatened occupants, law enforcement, security personnel or others familiar with the selected path of travel may also employ the audio and visual signaling components of the system in the threatened occupants' zone to instruct them on the desired path of travel and provide greater certainty that such occupants follow such path.

The system may alter its rate of dispersion and dissipation of vision obfuscating medium, the operation of locking mechanisms and other system components "on the fly" based upon continuous feedback from system's video or imaging components or other sensors, thereby improving the cost comparison in relation to the paths and increasing the likelihood of successfully executing the travel along the selected paths without contact between the attacker(s) and the threatened occupants. Likewise, the system may recalculate the paths in the event of unexpected behavior by one or more persons or the occurrence of additional relevant events warranting deviation from the initial path.

Temperature Control

As discussed previously herein, certain embodiments of the present invention include temperature control capability through the main controller and/or the zonal controllers. Such temperature control may be used to effect the proper level of vision obfuscation described above in further detail.

Redundancy

Among the novel advancements of the disclosed system and method are the ability to maintain the functional integrity of the system at all times through the use of redundant main controllers while also providing the ability for decentralized, self-controlled initiation and operation in each zone of the protected structure.

Some embodiments of the disclosed system provide protection from interruption of operation through the placement of redundant main controllers in two or more areas of the protected multi-zone structure. Each controller may also be protected from loss of power by the employment of redundant or alternate power sources, such as internal batteries, backup generator connectivity and the like. The redundancy of controllers and failsafe power supplies permit the operation and communication backbone of the system to continue functioning in the event of failure or disabling of the main controller or one co-main controller. In either event, the main controller detecting the absence of operation of another main controller may assume full control of the multi-zone structure. This failover main controller or now-primary co-main controller may continue standard operation of the system. The now-primary controller may also attempt to repair connectivity to the failed controller, seek to identify the cause of the failure of the other controller or communication pathway to it, or may reconfigure the operation of itself or one or more zone controllers based on information available to it, from the other components of the system, including the absence of availability of certain information. The now-primary controller may also relay status information to monitoring locations or third parties, such as law enforcement, in order to provide information that may assist in the resolution of the active threat situation or the repair of the system.

Further still, the controller of each zone of the multi-zone structure is configured for detection of failure of communication between the zone controller and the main controller or controllers. When the zone controller detects such failure, it determines to assume direct control of all components of its zone. The zone controller, in this way, becomes capable of independently activating pre-programmed, situationally contingent instructions for the execution of single-zone protective steps in accordance with the teachings of the disclosed system and method. The system assesses the real-time reach of the communication backbone. After determining its communication ability to other zone controllers and/or main controllers, the zone controller initiates the contingent procedures. This may cause the single zone controller to trigger operation steps directly, either in its zone or across multiple zones, or to report to another zone controller, which may then initiate single- or multi-zone operations consistent with the overall teachings of the present disclosure and with the entire system programming or contingent, situational system programming.

The system provides a novel means of controlling the path and mobility of the attacker, or attackers, and the occupants of the facility who are at risk. The methods of purposeful visual impairment described may also be coupled with programmatic or manual, situation-based control of zone or building entry and egress locking mechanisms. In this way, the combined use of the locking mechanisms and vision impairment material components through the PLC or processor may be used to guide the movement of the violent attacker, while visually tracking the violent attacker's location through the video or photographic components of the system or through sensors available in alternate embodiments of the disclosed system.

These means of controlling the paths and mobility of attacker and occupants may be initiated based on pre-programmed paths, identified by facility administrators, security consultants, law enforcement or others to be the most effective method of reduction of likely harm based on the identified situation. Through distribution of updates to the PLC's or processors, the system may update the pre-programmed execution plans based on human direction or based on machine-learning through the performance of active intrusion drills, strategic games and the like. In some embodiments, multiple pre-programmed control methods are entered, providing for initiation of the proper one of the multiple methods based on the identification to or by the system of the present situation in the facility and the selection of the method best suited to the achievement of containment, evacuation, deterrence or other goal. Some embodiments permit the recalculation of this selection at each step or at specified intervals to permit the system to change to a different pre-programmed method in response to a situational change.

Figure 2:
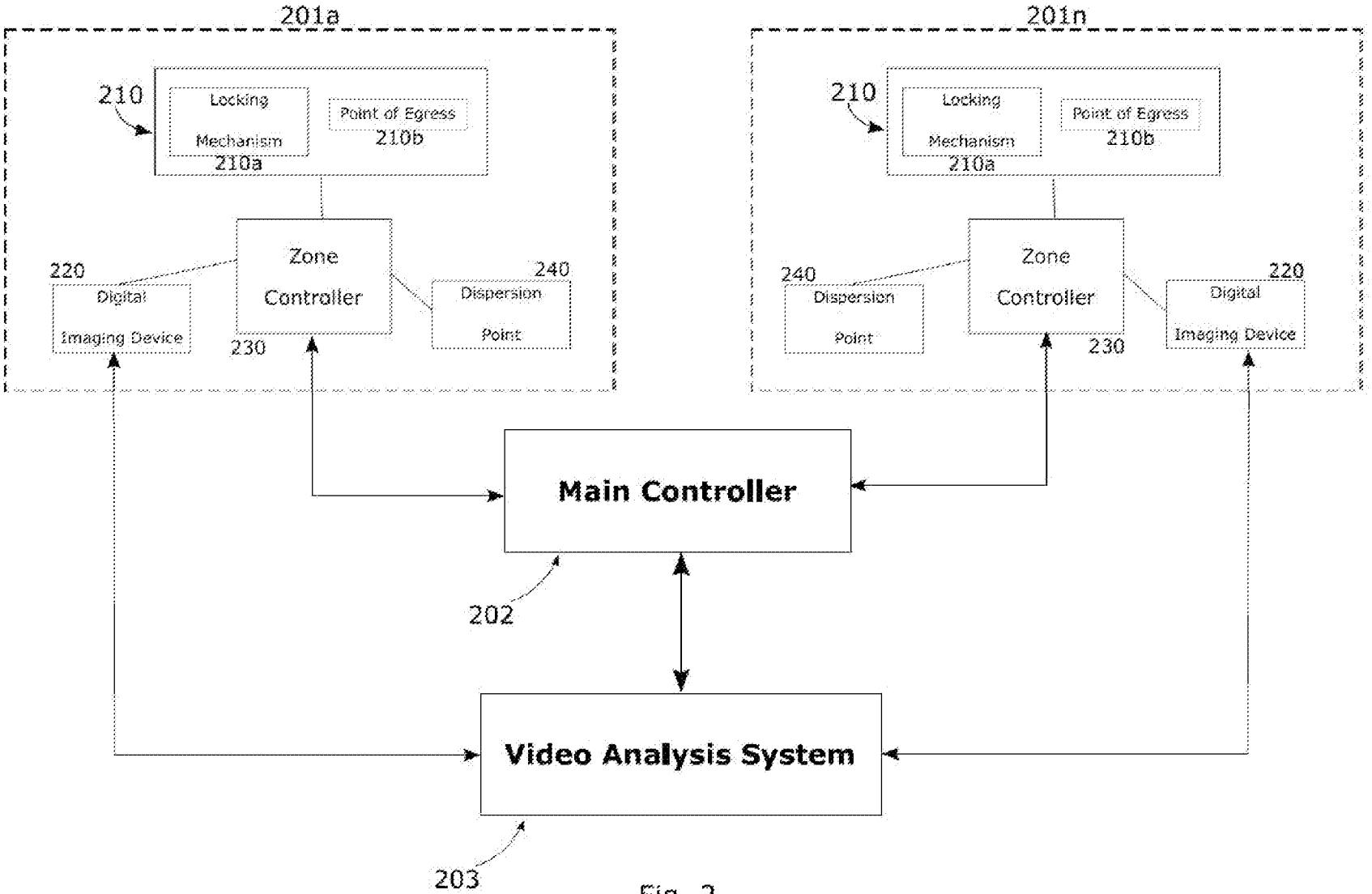
FIG. 2 is an exemplary block diagram of components and data flows of a system according to the present invention.

By way of example, as illustrated in the block diagram of FIG. 2, the programmable diversionary aspects of the system may employ the video components 220 of the system, in conjunction with intelligent image analysis systems 203 to determine the occupancy of each zone 201*a*-201*n*. The system may then compute a path for diversion of the intruder, such as the shortest path to a specified zone 201*a*-201*n* or to the exterior, or along a path, regardless of total distance, that is likely to place the intruder or actor in contact with the fewest people possible. This operation may alternatively be initiated or fully or partially operated by a human in response to viewing of the system's video relay. A person of skill in the art will understand that the foregoing example should not be considered limiting and that the system, by operation of its video aspects in conjunction with a series of recognition systems and automated controls may augment the components of the system or their operation by way of one or more of the controllers 202, 230 or communication components in a manner to effectively move the attacker or attackers away from potential victims. The result is that the components of the system operate in a fashion that will direct relays, closures and their component locking mechanisms 210*a*, visibility limiting mediums 240, and any other components of the system in a series of steps that prevent the attacker or attackers from moving freely through the structure. This series of functions will encourage the attacker or attackers to move toward egress points 210*b* that lead only to the outside of the structure or to interior areas determined to be likely to safely contain the attacker.

The system and method, as illustrated by the foregoing described embodiments, and as further described herein, provides to building administrators, law enforcement, building occupants and other people, the ability to initiate strategies and tactics, manually or by use of the system, to reduce human and property casualties from violent attacks immediately upon identification of such attack or the threat of such attack, prior to the time in which law enforcement or other outside assistance would be physically able to respond. The result is that the present system and method operate to mitigate harm to persons and damage to property immediately following identification of an active attacker situation, in the time before first responders are able to arrive.

What is claimed is:

1. A method for initiating automated procedures for mitigating injuries and fatalities to occupants of a structure comprising:

a. Identifying a plurality of zones within a building structure;

b. Installing within at least two of said plurality of zones a zone controller;

c. Installing within at least one of said plurality of zones at least one digital imaging device, a locking mechanism coupled to at least one covering of a point of egress from the zone, and at least one dispersion point for the dispersion of at least one dispersible substance;

d. Communicatively connecting at least the locking mechanism within each zone to the zone controller of that zone;

e. Communicatively connecting each of said zone controllers to a main controller;

f. Receiving at a video analysis system communicatively connected to at least one of said digital imaging devices digital imaging data from at least one of said digital imaging devices;

g. Making, by the execution of pre-programmed algorithms by said video analysis system, programmatic identification of the probable nature of the event represented by at least said digital imaging data;

h. Automatically initiating the execution of pre-programmed operation steps of at least one of said zone controllers in response to said programmatic identification.

2. The method of claim 1 further comprising installing within at least one of said plurality of zones a thermostatic member.

3. The method of claim 1 further comprising installing within at least one of said plurality of zones at least one acoustic detection device.

4. The method of claim 3 wherein said nature of the event is further represented by data from said acoustic detection device.

5. The method of claim 1 wherein said execution of pre-programmed operation steps comprises dynamically configuring via communicative operation of said locking mechanism and said dispersion point in at least one of said plurality of zones a path of egress from at least one of said plurality of zones based upon said programmatic identification.

6. The method of claim 1 wherein at least one of said pre-programmed algorithms comprises determination by said video analysis system of the number of occupants of at least one zone of said plurality of zones.

7. The method of claim 1 wherein at least one of said pre-programmed algorithms comprises machine learning steps.

8. The method of claim 7 wherein said probable nature of the event comprises unexpected behavior of one or more persons.

9. The method of claim 7 wherein said machine learning steps are implemented in the form of a computational neural network.

10. The method of claim 7 wherein said execution of pre-programmed operation steps comprises dynamically configuring via communicative operation of said locking mechanism and said dispersion point in at least one of said plurality of zones a path of egress from at least one of said plurality of zones based upon said programmatic identification.

11. The method of claim 7 wherein said machine learning steps may take as input data entered by a user of an input device in digital communication with at least one of said controllers.

12. The method of claim 1 wherein each of said zone controllers is implemented by a programmable logic controller.

13. The method of claim 1 wherein said main controller is implemented by a programmable logic controller.

14. The method of claim 1 wherein said main controller is logically implemented by a single physical programmable logic controller also implementing at least one of said zone controllers.

15. A life safety system for mitigating injuries and fatalities to occupants of a multi-zone structure comprising:

a. a plurality of controllers;

b. a plurality of digital image capture devices;

c. a plurality of locking mechanisms each coupled to at least one zonal egress point and at least a subset of said plurality of locking mechanisms connected to at least one of said controllers;

d. a plurality of dispersion points for the dispersion of at least one dispersible substance, and at least a subset of said plurality of dispersion points connected to at least one of said controllers;

e. a video analysis system communicatively connected to at least one of said digital image capture devices for the receipt of digital imaging data from at least one of said digital image capture devices;

f. at least one monitoring location physically removed from at least one of said digital image capture devices and from at least one of said controllers and from at least one of said dispersion points and from at least one of said locking mechanisms.

16. The system of claim 15 further comprising within at least one of said plurality of zones a thermostatic member connected to at least one of said controllers.

17. The system of claim 15 further comprising within at least one of said plurality of zones an acoustic detection device connected to at least one of said controllers.

* * * * *